US007049905B2

(12) United States Patent
Chen

(10) Patent No.: US 7,049,905 B2
(45) Date of Patent: May 23, 2006

(54) HIGH POWER DIRECTIONAL COUPLER

(75) Inventor: Lu Chen, Brooklyn, NY (US)

(73) Assignee: Scientific Components Coporation, Brooklyn, NY (US)

( * ) Notice: Subject to any disclaimer, the term of this patent is extended or adjusted under 35 U.S.C. 154(b) by 46 days.

(21) Appl. No.: 10/884,510

(22) Filed: Jul. 6, 2004

(65) Prior Publication Data

US 2005/0146393 A1 Jul. 7, 2005

Related U.S. Application Data

(60) Provisional application No. 60/533,797, filed on Jan. 2, 2004.

(51) Int. Cl.
*H01P 3/08* (2006.01)
*H01P 5/18* (2006.01)

(52) U.S. Cl. ..... 333/116; 333/246

(58) Field of Classification Search ..... 333/109, 333/116, 246
See application file for complete search history.

(56) References Cited

U.S. PATENT DOCUMENTS 3,617,952 A * 11/1971 Beech ..... 333/116
5,032,803 A * 7/1991 Koch ..... 333/116
5,742,210 A * 4/1998 Chaturvedi et al. ..... 333/116
6,208,220 B1 * 3/2001 Logothetis ..... 333/116

* cited by examiner

*Primary Examiner*—Dean Takaoka
(74) *Attorney, Agent, or Firm*—Kevin Redmond

(57) ABSTRACT

A directional coupler has a multi-layered low temperature co-fired ceramic substrate. A circuit line is located on one of the layers and is connected to an input port and an output port. Another circuit line is located on a different layer and is connected to a forward coupled port and a reverse coupled port. The circuit lines are located close to each other such that they are electromagnetically coupled. Ground planes are located on the top and bottom surfaces of the substrate.

18 Claims, 7 Drawing Sheets

HIGH POWER DIRECTIONAL COUPLER

This application claims the benefit of Provisional Application No. 60/533,797, filed Jan. 2, 2004.

BACKGROUND

1. Field of Invention

This invention relate to directional couplers in general and more particularly to directional couplers that have a small overall size.

2. Description of Related Art

Directional couplers are used in a variety of applications in the RF and microwave frequency range. FIG. 1 shows a schematic diagram of a prior art directional coupler 20 including a pair of coupled circuit lines 21 and 22 located between ground planes 23 and 24. This configuration is referred to as stripline. The circuit lines 23 and 24 are buried within a dielectric material, which commonly is a printed circuit board. The ground planes are one factor that determines the impedance and coupling of the circuit lines. The directional coupler 20 has four ports, an input port 25, an output port 26, a forward coupled port 27 and a reverse coupled port 28. An input signal or power applied to the input port 25 will go mainly to the output port 26. A portion of the input signal will be electromagnetically coupled to circuit line 22 and appear mostly at forward coupled port 27. A very small portion of the signal will go to the coupled reverse port 28.

The electrical signal coupled to the forward and reverse ports depends upon the coupled circuit line characteristic impedance and the coupling between the lines. Directivity is a measure of the directional coupler differentiation between ports.

Printed circuit boards have a dielectric material constant around 2.5. The low dielectric constant causes the overall size of the device to be large when designed for a given circuit line impedance.

A current unmet need exists for a directional coupler that is smaller with good electrical performance and that is low in cost to manufacture.

SUMMARY

It is a feature of the invention to provide a directional coupler that has a small size with good electrical performance.

It is a feature of the invention to provide a directional coupler that can be built in high volumes at low cost.

Another feature of the invention is to provide a directional coupler that includes a substrate having a top surface, a bottom surface and several layers. A first circuit line has a first end and a second end. The first circuit line is located on one of the layers. An input port is connected to the first end and an output port is connected to the second end. A second circuit line has a third end and a fourth end. The second circuit line is located on another layer. The first and second circuit lines are located proximate to each other such that they are electromagnetically coupled. A forward coupled port is connected to the third end and a reverse coupled port is connected to the fourth end. A first ground plane is located on the top surface and a second ground plane is located on the bottom surface.

BRIEF DESCRIPTION OF THE DRAWINGS

It is noted that the drawings of the invention are not to scale. In the drawings, like numbering represents like elements between the drawings.

DETAILED DESCRIPTION

Figure 1:
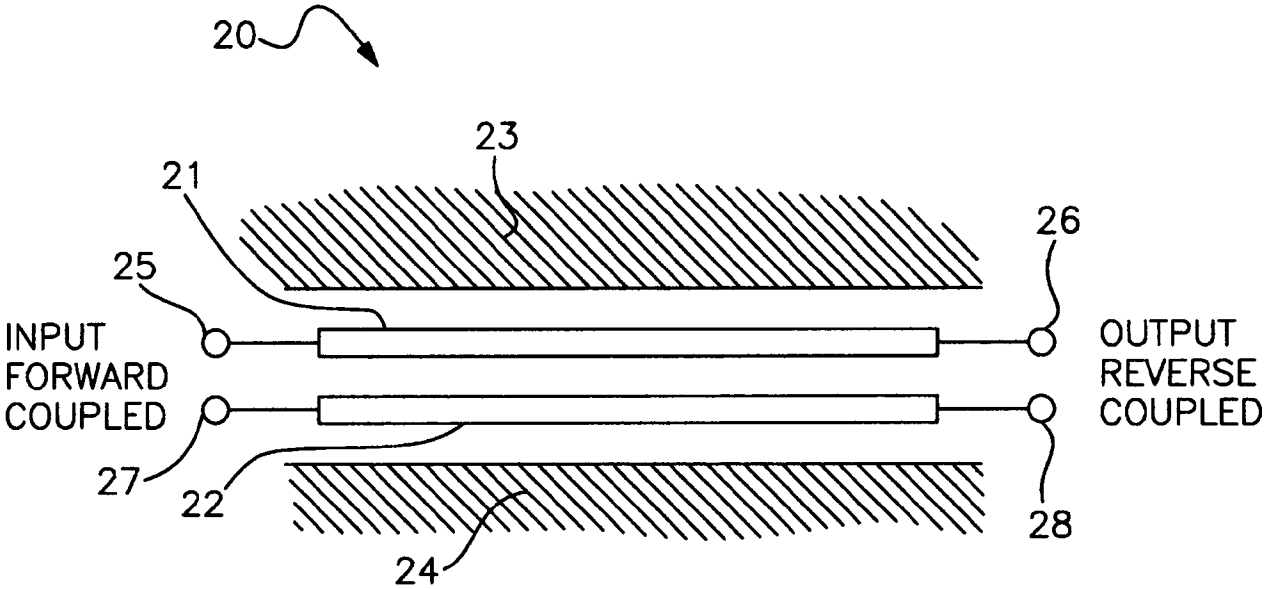
Fig. 1 (Prior Art)
FIG. 1 is a schematic drawing of a conventional directional coupler.
Figure 2:
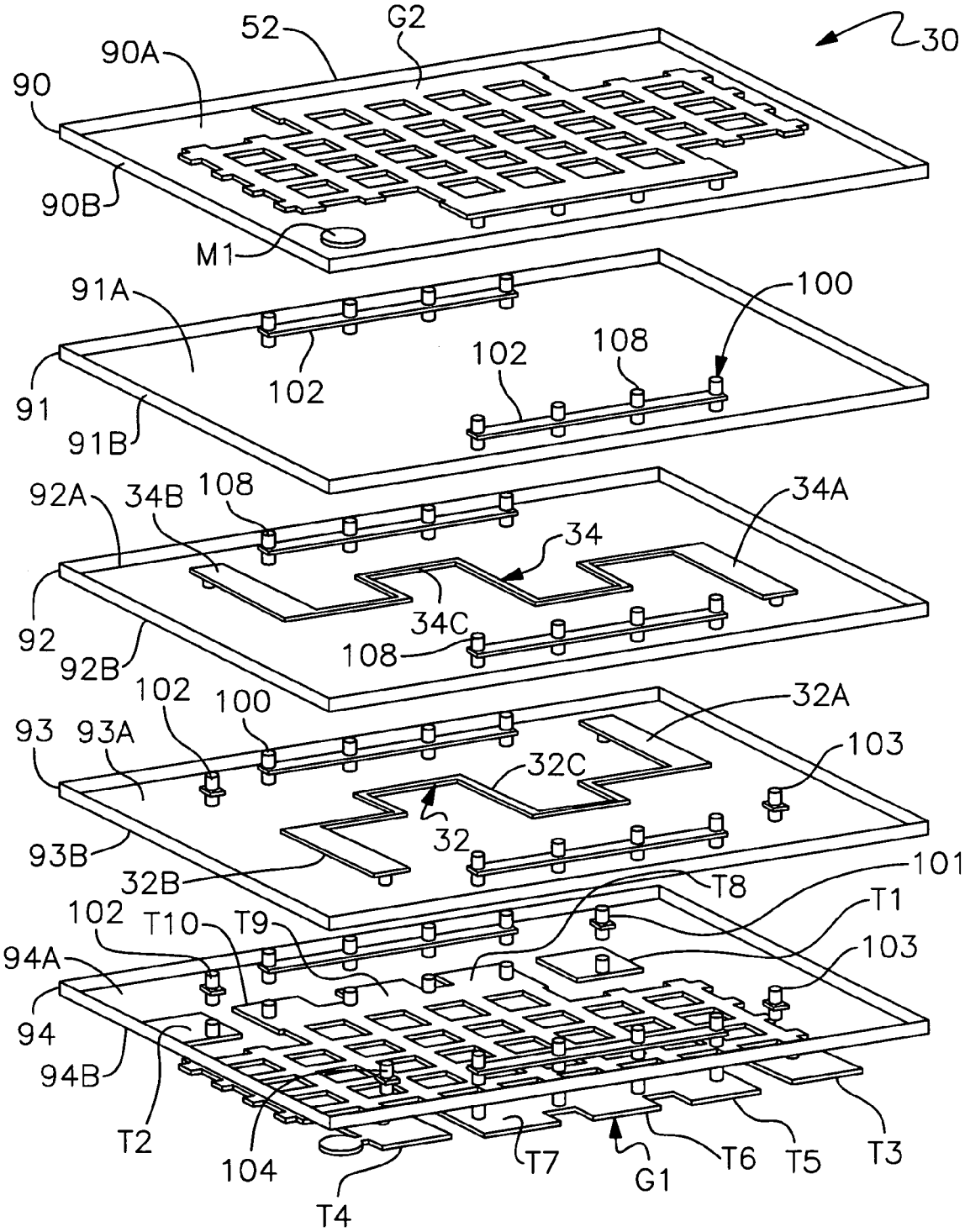
FIG. 2 is an exploded perspective view of the present invention.
Figure 3:
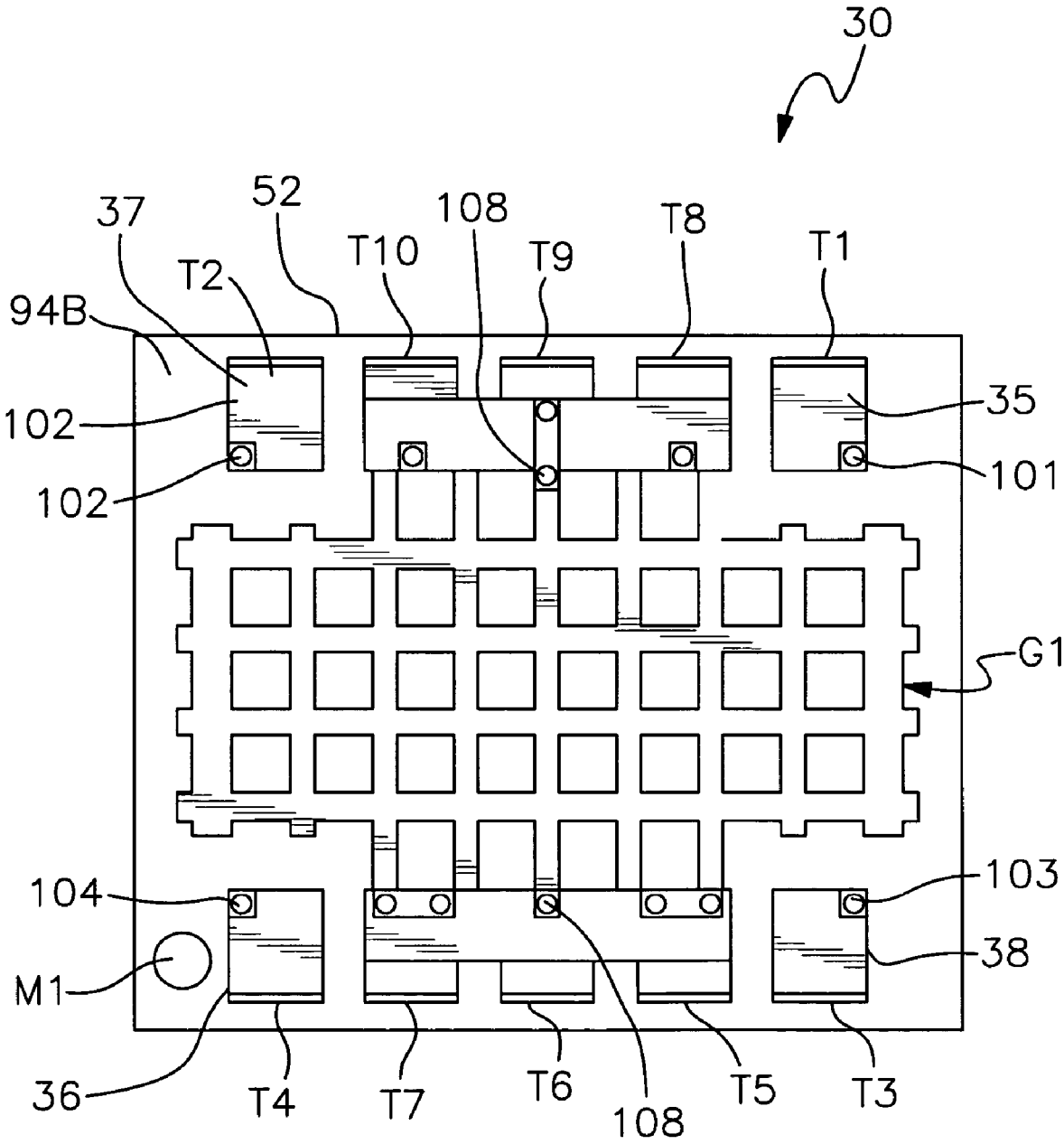
FIG. 3 is a bottom view of FIG. 2.

Referring now to FIGS. 2 and 3, a directional coupler 30 is shown. Directional coupler 30 has a substrate 52. Substrate 52 is a multi-layered dielectric substrate 52 formed from layers of low temperature co-fired ceramic (LTCC) material. Substrate 52 is comprised of multiple layers 90, 91, 92, 93 and 94 of LTCC material. There are 5 LTCC layers in total. Substrate 52 has a top surface 90A and bottom surface 94B. Various circuit features are patterned on the layers.

Several conductive terminals are located on bottom surface 94B. The terminals are formed from a solderable metal. Terminals T1, T2, T3 and T4 are located on bottom surface 94B. Ground shield or plane G1 is located on bottom surface 94B and has ground terminals T5, T6, T7, T8, T9 and T10. Ground shield or plane G2 is located on top surface 90A. The ground terminals would be soldered to a source of ground potential.

Terminal T1 corresponds to the output port 35. Terminal T2 is the forward coupled port 37. Terminal T3 is the reverse coupled port 38. Terminal T4 is the input port 36.

The terminals are used to electrically connect substrate 52 to a printed circuit board (not shown). The terminals would typically be soldered to the printed circuit board. An orientation mark M1 is placed on top surface 90A in order to prevent incorrect installation on the printed circuit board.

Planar layers 90, 91, 92, 93, and 94 are all stacked on top of each other and form a unitary structure 52 after firing in an oven. Layer 90 is the top layer, layer 94 is the bottom layer and layers 91, 92 and 93 form inner layers. The layers are commercially available in the form of an unfired tape. Each of the layers has a top surface 90A, 91A, 92A, 93A and 94A. Similarly, each of the layers has a bottom surface 90B, 91B, 92B, 93B and 94B. The layers have several circuit features that are patterned on the surfaces. Multiple vias 100 extend through each of the layers. Vias 100 are formed from an electrically conductive material and electrically connect the circuit features on one layer to the circuit features on another layer.

Coupled circuit line 32 is formed on surface 93A. Coupled circuit line 34 is formed on surface 92A. Coupled circuit line 32 has wide ends 32A and 32B and a thin center section 32C. Coupled circuit line 34 has wide ends 34A and 34B and a thin center section 34C. Circuit lines 32 and 34 have a snake like, winding or sinuous shape and are located directly above each other on different planes. Circuit lines 32 and 34 are separated by layer 92. Circuit lines 32 and 34 are electromagnetically coupled through the dielectric medium of layer 92. The circuit lines are formed from a conductive metal material. Circuit lines 32 and 34 are referred to as striplines because they are sandwiched between ground or reference planes G1 and G2.

Via 101 connects terminal T1 to circuit line end 32A. Via 102 connects terminal T2 to circuit line end 34B. Via 103 connects terminal T3 to circuit line end 34A. Via 104 connects terminal T4 to circuit line end 32B.

A mesh ground shield or plane G2 is formed on surface 90A. Another mesh ground shield or plane G1 is formed on surface 94B. Ground buss 102 connects several of the grounded vias 108 together on layers 91, 92 and 93.

The circuit features such as the vias, circuit lines, terminals and ground planes are formed by screening a thick film paste material and firing in an oven. This process is well known in the art. First, layers of low temperature co-fired ceramic have via holes punched, the vias are then filled with a conductive material. Next, the circuit features are screened onto the layers. The terminals, lines and ground planes are formed with a conductive material. The layers are then aligned and stacked on top of each other to form substrate 52. The substrate 52 is then fired in an oven at approximately 900 degrees centigrade to form a single unitary piece.

A directional coupler 30 in the form of substrate 52 was designed, fabricated and tested for electrical performance over the frequency range of 1200 to 4200 MHz. Substrate 52 as built and tested had an overall substrate size of 0.3 inches by 0.25 inches by 0.27 inches. The circuit lines 32 and 34 were designed for an impedance of 50 ohms. Circuit lines 32 and 34 have a line width of 0.005 inches and a line thickness of 0.0003 inches. The vias had a diameter of 0.008 inches. The dielectric constant of the low temperature co-fired ceramic layers was 7.8.

Figure 4:
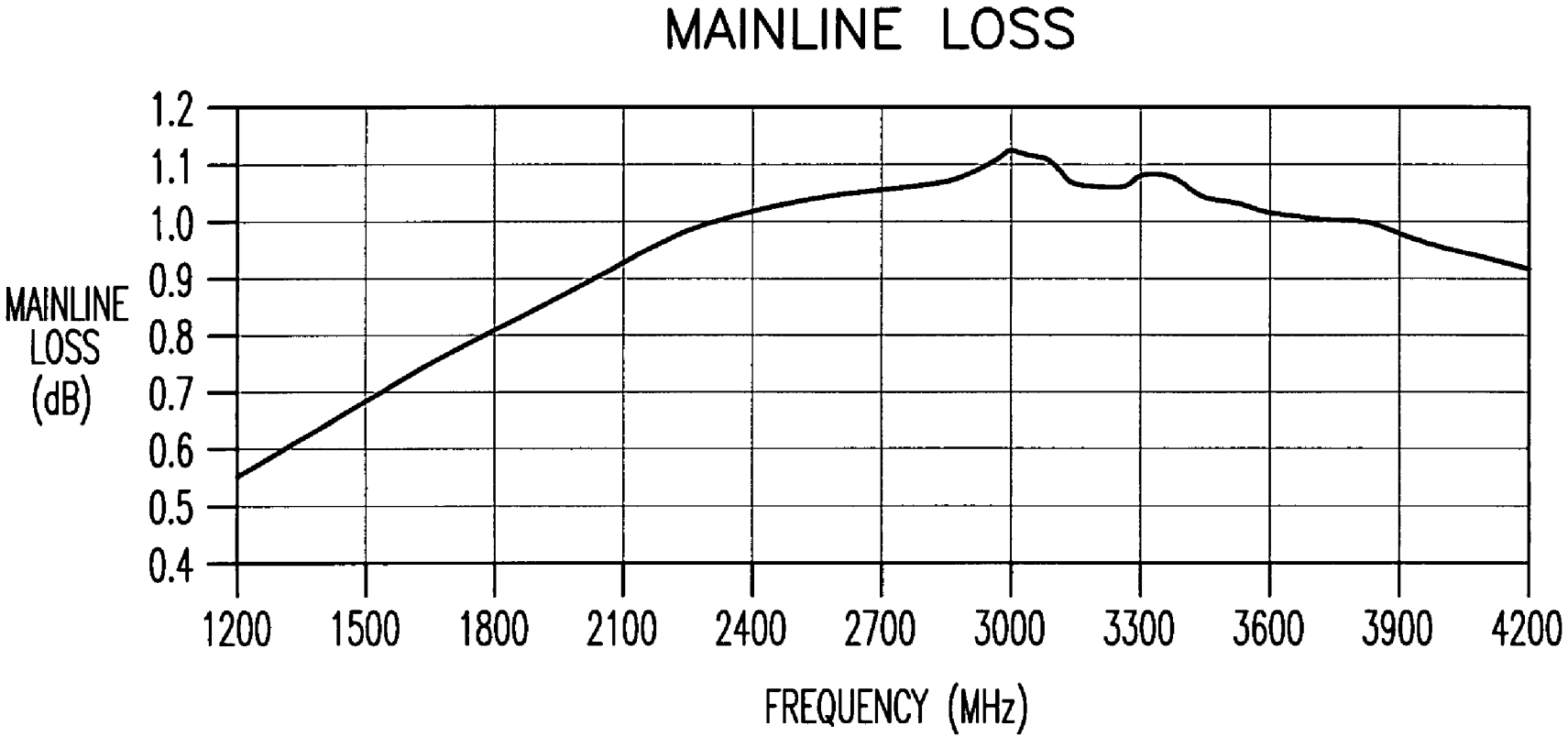
FIG. 4 is a graph of main line loss versus frequency for the directional coupler of FIG. 2.
Figure 5:
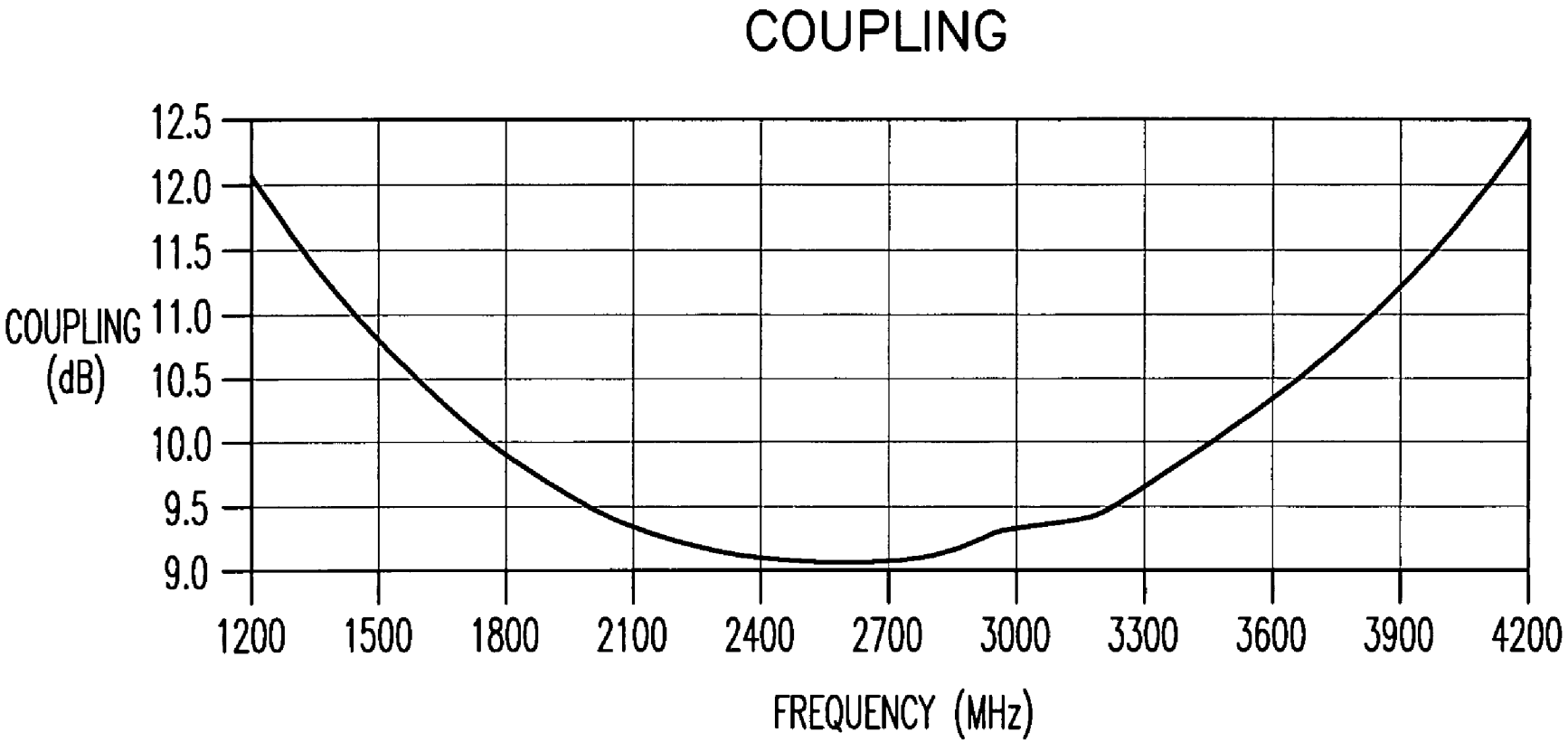
FIG. 5 is a graph of coupling versus frequency for the directional coupler of FIG. 2.
Figure 6:
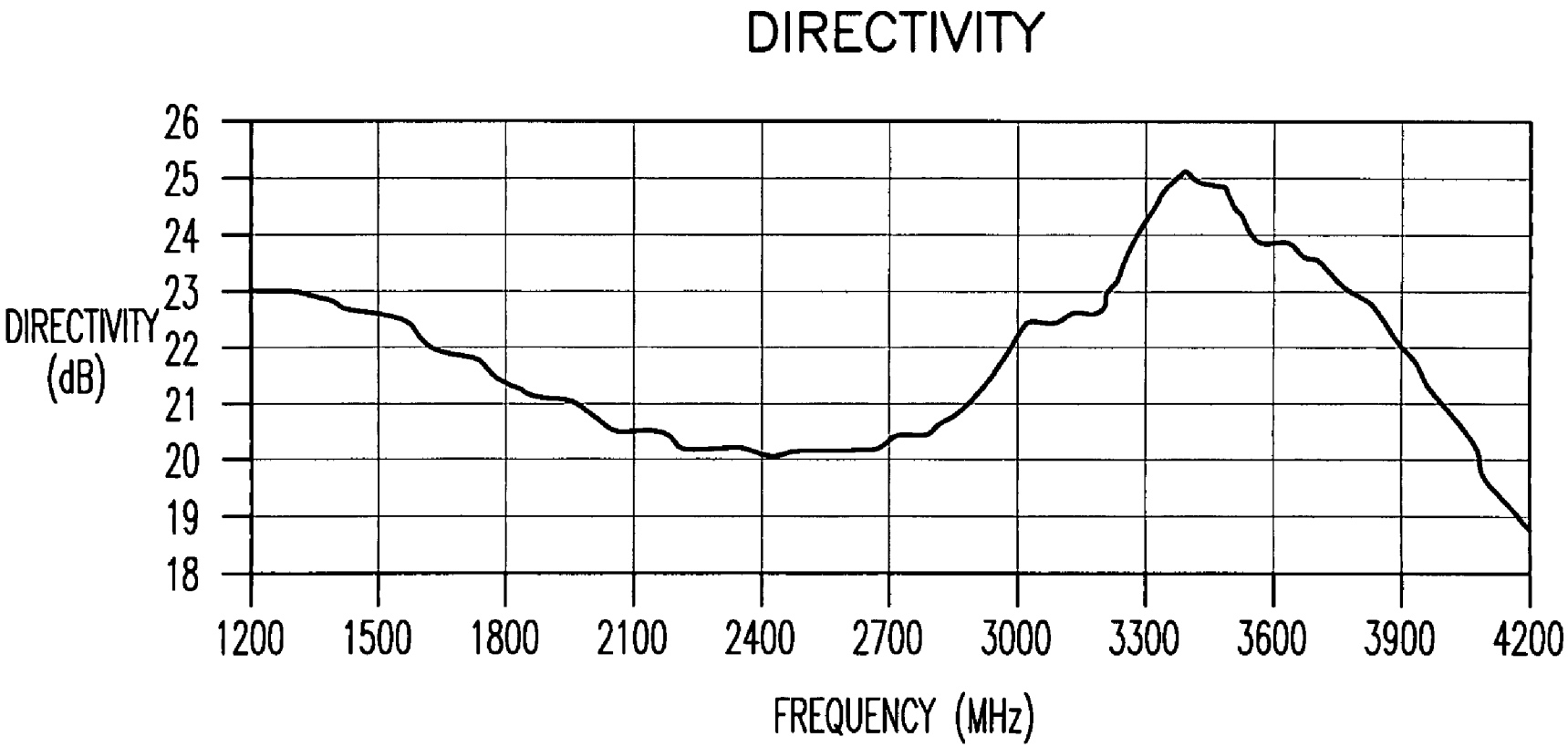
FIG. 6 is a graph of directivity versus frequency for the directional coupler of FIG. 2.
Figure 7:
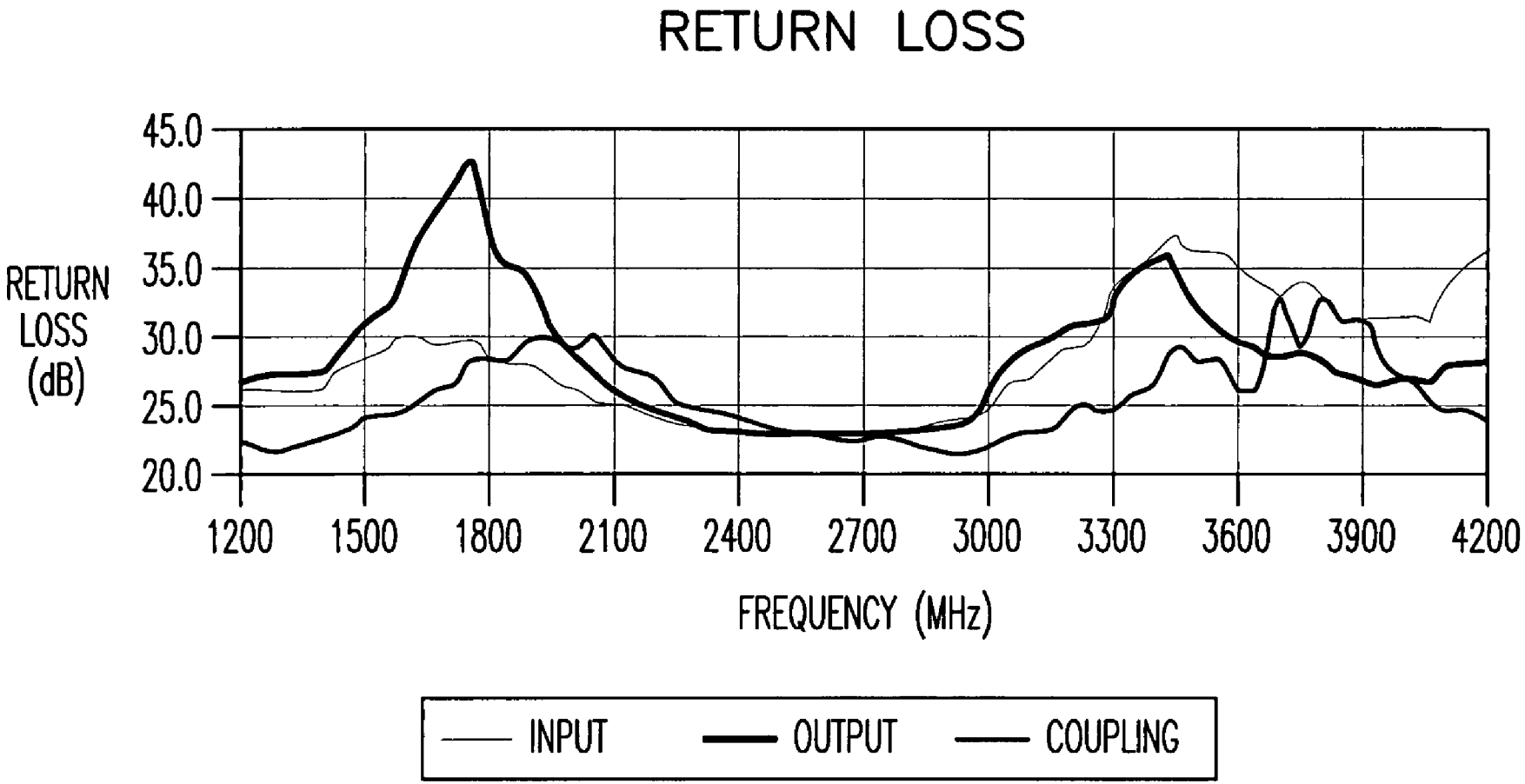
FIG. 7 is a graph of return loss versus frequency for the directional coupler of FIG. 2.

FIGS. 4–7 show the electrical performance of directional coupler 30. Turning now to FIGS. 4–7, a graph of mainline loss versus frequency for directional coupler 30 is shown in FIG. 4. FIG. 5 shows a graph of coupling versus frequency. FIG. 6 is a graph of directivity versus frequency. FIG. 7 is a graph of return loss versus frequency at the ports. Directional coupler 30 maintains good electrical performance while being considerably smaller than the prior art devices.

The present invention has several advantages.

Directional coupler 30 is smaller than previous devices and therefore takes up less room when mounted on a printed circuit board.

Fabricating the substrate 52 using a low temperature co-fired ceramic process results in more uniform electrical characteristics.

Because directional coupler 30 is small, more individual couplers can be fabricated from the same sheet of ceramic tape resulting in a lower unit cost.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A directional coupler comprising:

a) a substrate having a top surface, a bottom surface and a plurality of layers;

b) a first circuit line having a first end and a second end, the first circuit line located on one of the layers;

c) an input port connected to the first end and an output port connected to the second end;

d) a second circuit line having a third end and a fourth end, the second circuit line located on another layer, the first and second circuit lines located proximate to each other such that they are electromagnetically coupled;

e) a forward coupled port connected to the third end and a reverse coupled port connected to the fourth end;

f) a first ground plane located on the top surface;

g) a second ground plane located on the bottom surface; and h) a plurality of ground vias connected between the first and second ground planes.

2. The directional coupler according to claim 1, wherein the substrate is low temperature co-fired ceramic.

3. The directional coupler according to claim 1, wherein the first and second circuit lines have a winding shape.

4. The directional coupler according to claim 1, wherein the first and second circuit lines are opposed to each other with one of the layers located therebetween.

5. The directional coupler according to claim 1, wherein a plurality of vias connect the circuit lines to the ports.

6. The directional coupler according to claim 1, wherein a first, second, third and fourth terminal are located on the bottom surface.

7. The directional coupler according to claim 6, wherein the first terminal is connected to the third end, the second terminal is connected to the first end, the third terminal is connected to the second end and the fourth terminal is connected to the fourth end.

8. A directional coupler comprising:

a) a substrate having first, second, third, fourth and fifth layers, b) a first circuit line located on the third layer and having a winding shape, the first circuit line having a first and second end;

c) a second circuit line located on the fourth layer and having a winding shape, the second circuit line having a third and fourth end;

d) the first and second circuit lines being coupled to each other;

e) a first ground plane located on the first layer;

f) a second ground plane located on the fourth layer;

g) a first, second, third, and fourth terminal located on the fourth layer;

h) a first via extending between the first terminal and the third end;

i) a second via extending between the second terminal and the first end;

j) a third via extending between the third terminal and the second end; and k) a fourth via extending between the fourth terminal and the fourth end.

9. The directional coupler according to claim 8, wherein the substrate is fabricated from a low temperature co-fired ceramic.

10. The directional coupler according to claim 8, wherein the substrate is less than or equal to 0.3 inches in length by 0.25 inches in width by 0.27 inches in height.

11. The directional coupler according to claim 8, wherein the first and second ground planes are connected together.

12. A directional coupler comprising:

a) a multi-layered substrate, the substrate having an upper surface and a lower surface, a first ground plane located on the upper surface and a second ground plane located on the lower surface;

b) a first circuit line located within the substrate on a first layer and having a first and second end;

c) a second circuit line located within the substrate on a second layer and having a third and fourth end;

d) a first, second, third and fourth terminal located on the lower surface;

e) a first via extending between the first terminal and the first end;

f) a second via extending between the second terminal and the second end;

g) a third via extending between the third terminal and the third end;

h) a fourth via extending between the fourth terminal and the second end; and i) a plurality of ground vias connected between the first and second around planes.

13. The directional coupler according to claim 12, wherein the substrate is low temperature co-fired ceramic.

14. The directional coupler according to claim 12, wherein the first and second circuit lines have a winding shape.

15. The directional coupler according to claim 12, wherein the first and second circuit lines are opposed to each other with one of the layers located therebetween.

16. The directional coupler according to claim 12, wherein the circuit lines have a thin center portion and wide ends.

17. The directional coupler according to claim 12, wherein a plurality of ground terminals are located on the lower surface.

18. The directional coupler according to claim 12, wherein a ground bus is connected between the ground vias.

* * * * *